United States Patent [19]

Fauvel et al.

[11] Patent Number: 4,580,500

[45] Date of Patent: Apr. 8, 1986

[54] MULTIPLE CHARGE MUNITION, E.G. A COMBINED ANTI-TANK AND ANTI-PERSONNEL MINE FOR BROADCAST SCATTERING

[75] Inventors: Jean-Robert Fauvel, Muret; Philippe Rousseau, Paris; Pierre Thebault, Ramonville Saint Agne; Daniel Van Schendel, Muret, all of France

[73] Assignee: Etienne Lacroix Tous Artifices, Muret, France

[21] Appl. No.: 624,830

[22] Filed: Jun. 26, 1984

[30] Foreign Application Priority Data

Jun. 27, 1983 [FR] France ..... 83 10572

[51] Int. Cl.[4] ..... F42B 23/24

[52] U.S. Cl. ..... 102/401

[58] Field of Search ..... 102/401, 424, 425

[56] References Cited

U.S. PATENT DOCUMENTS 4,252,062 2/1981 Auge ..... 102/401

4,391,198 7/1983 Auge ..... 102/401

FOREIGN PATENT DOCUMENTS 2071271 9/1971 France ..... 102/401

*Primary Examiner*—Charles T. Jordan

*Attorney, Agent, or Firm*—McCormick, Paulding & Huber

[57] ABSTRACT

The munition comprises a munition body (100) which may enclose an anti-tank mine; a cover (200) for the munition body and constituting a support for a plurality of ejectable charges (300–305), e.g. anti-personnel mines. The munition is placed or scattered on the ground while it is in the closed position. Thereafter it opens, the anti-tank mine is activated, and the anti-personnel mines are ejected in a cluster around the anti-tank mine, whereby a plurality of identical munitions may be laid to set up a combined anti-tank and anti-personnel barrage.

11 Claims, 4 Drawing Figures

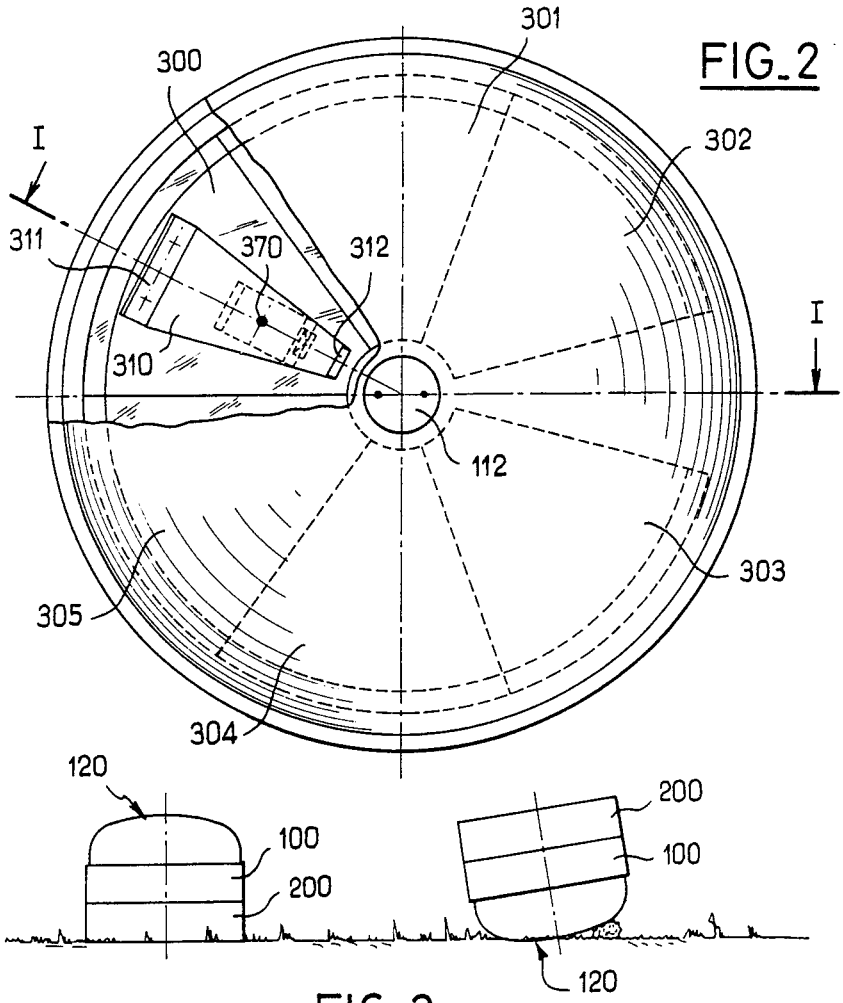
FIG_2
FIG_3
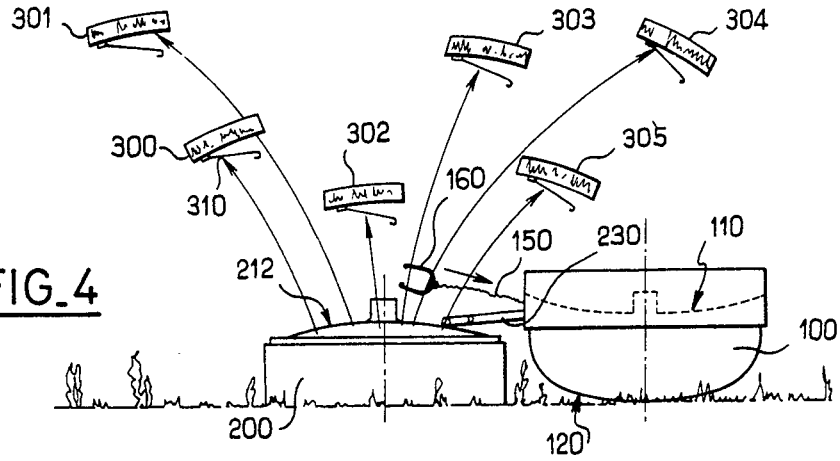
FIG_4

MULTIPLE CHARGE MUNITION, E.G. A COMBINED ANTI-TANK AND ANTI-PERSONNEL MINE FOR BROADCAST SCATTERING

The present invention relates to a multiple charge munition, for example a combined anti-tank and anti-personnel mine. The invention relates in particular to scatterable munition.

BACKGROUND OF THE INVENTION

Scatterable munitions are generally "broadcast", i.e. thrown out higgledy-piggledy onto the ground from a point situated at a certain height above the ground. The munitions then fall to the ground, where they may bounce or roll before coming to rest. They are then activated, i.e. armed from the explosive point of view.

The term "scattered" is additionally used herein to include munitions which are merely placed on the ground, either manually or mechanically, without being buried and which are activated after a certain lapse of time from the moment they are placed.

An aim of the invention is to provide a munition which, once in place on the ground, can itself eject a plurality of sub-munitions round about (the sub-munitions may also be called "ejectable charges").

SUMMARY OF THE INVENTION

The present invention provides a multiple charge munition, for example a combined anti-tank and anti-personnel mine, wherein the munition comprises:

a charge support which is generally flat in shape and which has an upwardly directed support face;

a plurality of juxtaposed ejectable charges, lying on the support face;

ejector means for each of the charges for scattering the charges at a distance from the charge support;

locking means for the ejector means for holding the charges against the support face of the charge support; and triggering means for releasing the locking means and ejecting the charges.

This thus provides two stages of scattering: an initial stage when the munitions are released from above the ground; and a second stage when the sub-munitions carried by each of these main munitions are scattered from the main munitions once they themselves are on the ground.

Further, if each charge support is itself fixed to a corresponding (non-ejectable) charge, a cluster of mines can be constituted around each main munition, e.g. a mixed munition cluster comprising a central non-ejectable anti-tank mine surrounded by anti-personnel mines (i.e. the sub-minutions).

It is conventional practice to lay clusters of mines by hand, but up to now, it has not been possible to transfer this technique to scatterable mines which a priori are the type of mine least suitable to clustering because their exact positioning and distribution are haphazard and difficult to control.

In contrast, a munition in accordance with the invention makes it possible to set up an anti-tank barrage, for example, which is made more effective by anti-personnel mines making the obstacle that much harder to penetrate.

In an advantageous embodiment, the charge support comprises a munition cover, which further includes:

a generally flat munition body including a bearing face and an exposed face, the exposed face being upwardly directed when the mine rests on the ground in the open position, said munition body being covered, in the closed position by the charge support having its support face turned towards the exposed face of the munition body;

a hinge connecting the charge support to the munition body at a peripheral point thereof;

locking means for locking the charge support to hold it in the closed position against the munition body; and opening means for unlocking the charge support and for exerting a pivoting torque thereon to cause it to move through half a turn from the closed position to an open position in which the charge support rests to one side of the munition body with its support face pointing upwards;

said pivoting torque being at least equal to the torque required for overturning the munition body in the event that prior to opening the body was resting with its exposed face pointing downwards.

The munition is thus particularly appropriate for scattering from a height: it is released while in the closed position and does not open until after it has hit the ground and come to rest, optionally after an opening time delay has lapsed.

Depending on whether the mine comes to rest the right way up (the cover on top) or upsidedown, the charge-supporting cover either merely opens to expose the exposed face of the mine body (e.g. the sensitive face of an anti-tank mine) and placing itself to one side thereof, or else it causes the entire munition to turn over so that its final position is correct and identical to the position which it would have been in naturally had it come to rest the right way up.

Advantageously, the opening means co-operate with the trigger means in such a manner as to release the locking means of the ejector means and to eject the charges so soon as the charge support reaches its open position. Opening thus automatically causes the ejectable charges to be expelled.

The embodiment of the invention which is described in detail below is a scatterable combined anti-tank and anti-personnel mine, but this type of munition is not the only type of munition to which the invention may be applied. The invention is also applicable, for example, and albeit less advantageously, to the following types of munition:

munitions which are placed on the ground without being scattered from a height;

single type munitions, i.e. including anti-personnel mines only without an associated anti-tank mine;

munitions containing charges other than explosive charges, e.g. smoke generators for laying down a smoke screen in a mined area. Anti-tank mines may also be combined with smoke generators, either by simultaneously scattering different types of munition, or by providing sub-munitions of various different types within the same munition.

BRIEF DESCRIPTION OF THE DRAWINGS

An embodiment of the invention is described by way of example with reference to the accompanying drawings, in which:

FIG. 2 is a plan view of the same mine seen from II—II in FIG. 1;

FIG. 3 shows two mines that have come to rest on the ground, one the right way up (on the right) and one upsidedown (on the left); and FIG. 4 shows a mine at the moment of opening and ejecting its sub-munitions.

MORE DETAILED DESCRIPTION

Figure 1:
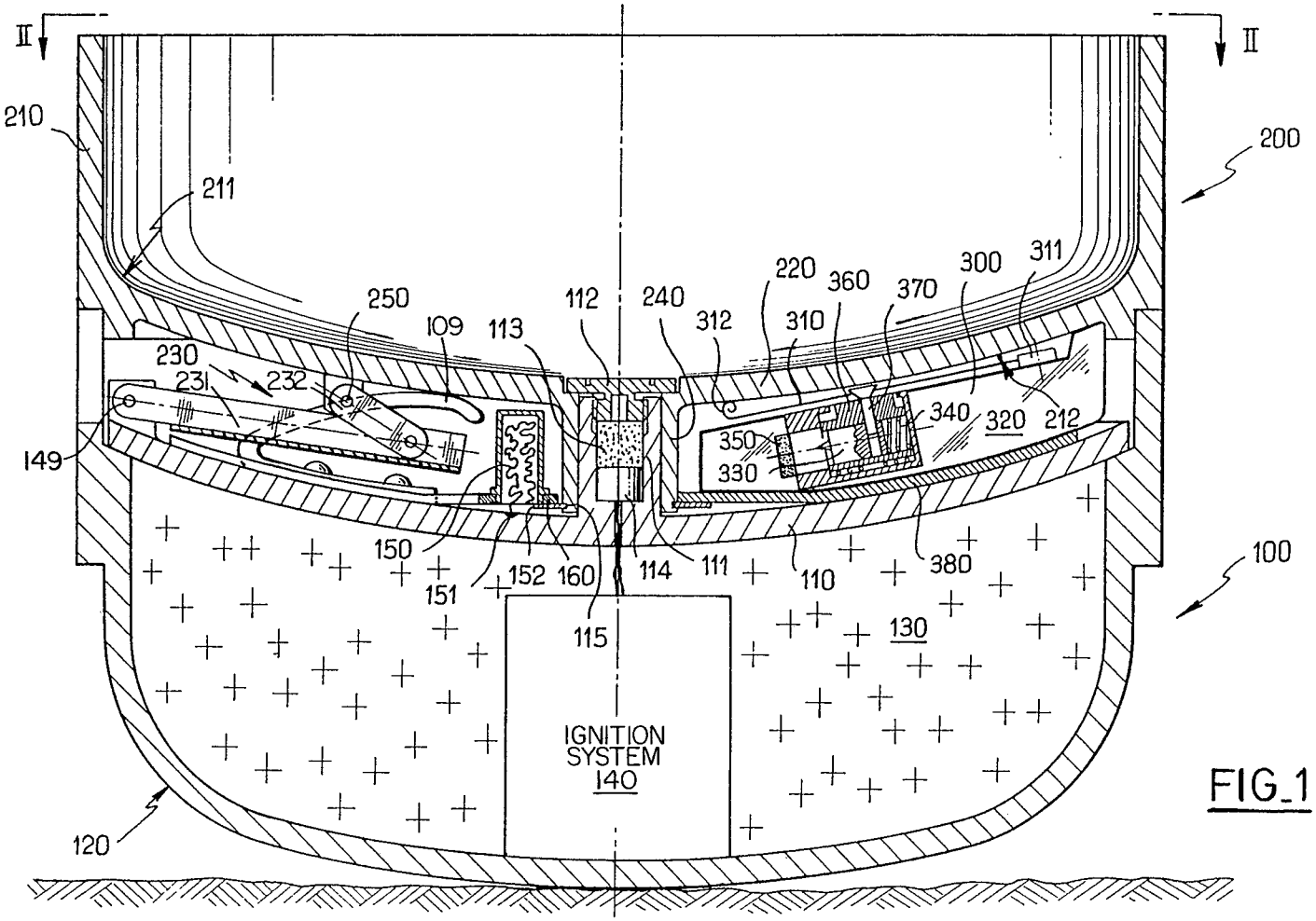
FIG. 1 is a cross section on a line I—I FIG. 2 through a combined mine in accordance with the invention after coming to rest on the ground but before opening.

FIG. 1 shows the body of a munition 100 covered by its cover 200 prior to opening. The cover 200 constitutes a support for charges such as a charge 300. The plan view of FIG. 2 has a cut away portion of the cover to show one charge 300 and to show that there are six charges 300 to 305 in all, equally spaced in adjacent sectors of a circle. The thickness of the charges is substantially equal to the gap between the face 212 of the cover that supports the munitions and the upper face 110 of the munition body.

The munition body 100 comprises a casing, e.g. of synthetic material which is closed by a metal plate 110 constituting the upper or exposed face of the munition body (i.e. this face is always upwardly directed when the mine enclosed in the munition body is in the active position). The plate 110 is generally concave and its inside face is in direct contact with the explosive charge 130 in the conventional structure of a plate-projecting mine.

The under face 120 of the munition body, i.e. the face which rests on the ground when the mine is in the active position, is in the form of a circularly symmetrical convex body with a gradually sloping outside surface to make it very stable about its right way up position, i.e. with the exposed face 110 uppermost.

The explosve 130 which is enclosed in the munition body is a shaped charge explosive; an ignition system 140 is also provided which includes, in addition to pyrotechnical means for intitiating an explosion, means (e.g. electronic means) for detecting a target, e.g. for detecting an armored vehicle by induction effects. The ignition system is preferably programmable and is connected to its power supply just before the munitions are scattered.

The ignition system 140 also includes detector means to detect the munition's impact with the ground, together with time delay means which are triggered by the impact detector means, to arm the pyrotechnical chain of the mine contained in the body of the munition at a suitable instant after impact. A suitable time delay corresponds to the maximum expected time for the mine to come to a complete halt. It is shown later that the same time delay means can be used to time the opening of the munition cover.

The cover 200 includes a surface 220 which, in the closed position, completely covers the exposed face 110 of the munition body together with the sub-munitions 300–305. This surface extends radially overall and further extends axially upwardly in the form of a generally cylindrical rin 210, thereby enabling:

the munition's bearing surface on the ground to be maximized once the cover is deployed, the upturned cover serving, in addition, as a support for the sub-munitions;

the munition's center of gravity to be moved off-center when the cover is in the closed position, thereby giving a preferential stable equilibrium position with the cover uppermost; and the upper surface 211 of the cover to have a female shape which matches the male shape of the lower surface 120 of the munition, thus making the munitions stackable, which is particularly advantageous for scatterable munitions which are intended to be used in large numbers and which therefore need to be stored in a rationalized manner.

The cover 200 is connected to the body of the munition 100 by an articulated arm 230 extending between a peripheral point 149 of the body of the munition and a point 250 on the cover. The articulated arm, e.g. comprising two links 231, 232, is deployable in such a manner (as is explained below) that in the open position the assembly constituted by the arm and the cover holds both the exposed face of the munition body and the charge-supporting face of the cover in a generally horizontal configuration.

In the closed position, the cover is locked to the munition body, e.g. by a hollow portion 240 fitting over a projecting portion 111 of the exposed face 110. An explosive bolt 112 is then screwed into the projecting portion to hold down the cover 200. After the munition has come to rest on the ground, and for example under the control of the ignition means and the time delay means 140, a charge 113 is ignited by a detonator 114 causing the bolt 112 to explode.

The sub-munitions 300–305 are, for example, anti-personnel mines comprising a plate explosive 320. These explosives are flexible, are simply protected against the weather, and are provided with a very conventional triggering system comprising a hammer 330, a spring 340 applying force thereto and a fuse 350. The hammer is held by a tab 360 in such a manner that light pressure on the triggering arrangement (e.g. because the mine has been trodden on by a foot or picked up by a hand) triggers the explosion.

Each anti-personnel mine is provided with a spring 310, e.g. a blade spring (see also FIG. 2) with one end fixed to the mine 300 and with its other end 312 held pressed against the charge support face 220.

Advantageously, the spring 310 is provided adjacent to the triggering mechanism with an opening through which a safety pin 370 is slid to lock the hammer in place until it is ejected by the blade spring being released. The act of expelling the charges is thus combined with the act of arming them.

In the closed position, the charges 300–305 are held in place by a disk 380 which is itself held in position by fork 160 which is inserted in a radial slot 115 in the projecting portion 240 of the cover. The assembly constituted by the cover and the charges it supports thus remains held together until the fork 160 has been extracted from the slot 115—and in particular while the cover is opening.

The fork may be extracted, for example, by means of a wire 150 having one end 151 fixed to the body of the munition 100 and having its other end 152 connected to the fork. The length of the wire 150 is so chosen that when the charge-supporting cover and the corresponding munition body are in the open position, the wire exerts sufficient tension on the fork 160 to extract it radially from the slot, thereby releasing the set of ejectable charges carried by the charge support 220.

It will be observed that in the closed position the ejectable charges 300–305 are protected against crushing by the cover 220 and the metal plate 110, and by the spring 310 which is then on top. Protection is thus provided against shocks to which the munition may be subjected while in the closed position.

FIGS. 3 and 4 show the operation of the munition. FIG. 3 shows two possible positions in which the munition may come to rest on the ground before opening: most often the munition comes to rest the right way up because of its off-center center of gravity (due to the hollow cylindrical rim 210 on the cover) and because of its convex bearing surface 120. This position is shown to the right in FIG. 3 in which the bearing surface 120 can be seen to be in contact with the ground.

However, the mine may (albeit rarely) come to rest upside-down as shown to the left in FIG. 3, i.e. with the bearing surface 120 uppermost and with the charge-supporing cover 200 resting on the ground.

After the time delay has expired, the explosive bolt 112 is expelled, thus unlocking the cover. Opening means, which may comprise mechanical means such as a spring 109 or else explosive means, apply a pivoting torque tending to cause the munition to move from its closed position (FIG. 3) to its open position (FIG. 4). This requires the cover 120 to move through about half a turn (i.e. about 180°) relative to the body 100 of the munition.

If the munition comes to rest the right way up (right hand side of FIG. 3), opening the cover simply uncovers the exposed face 110 of the munition body. The size of the articulated arm 230 and of the movement it can perform are so chosen that the exposed face 110 of the munition body remains in a generally horizontal position, as does the charge-supporting face of the cover 200.

However, if the mine comes to rest upsidedown (left hand side of FIG. 3) the opening means exert their pivoting torque on the body 100 of the munition, and the torque is great enough to ensure that the body is turned over. In this case, the charge-supporting cover 200 stays in place while the munition body 100 is moved to a point adjacent to the cover, where it finally comes to rest the right way up.

It will be observed that in the final position, the charge-supporting cover 200 always has its supporting face pointing upwardly, thus uncovering the charges which it had been carrying on its back.

At the end of the opening movement (see FIG. 4), the wire 150 is pulled taut and extracts the fork 160 from its radial slot. The charges 300 to 305 are then ejected all around the support (e.g. to a radius of 2 to 3 meters) under the effect of their blade springs 310 releasing.

Thus, in the example illustrated, a cluster of mines is laid comprising a central anti-tank mine (enclosed in the munition body 100) surrounded by six anti-personnel mines scattered all around the central mine.

In a variant, the munition body 100 need not contain any charge; in which case it simply plays mechanical role of protecting and then of positioning the charge support 200.

In another variant, the non-ejectable charge may be contained in the charge support 200 instead of being in the munition body 100. This variant can be used to set up a combined cluster of mines including a central anti-tank mine surrounded by anti-personnel mines.

If the non-ejectable charge is situated in the charge-support 200, or if anti-personnel mine scattering is all that is required, the munition body 100 may be omitted with the munition comprising just the support 200 with the ejectable charges locked thereto by any suitable means.

We claim:

1. A multiple charge munition, for example a combined anti-tank and anti-personnel mine, wherein the munition comprises:

a charge support which is generally flat in shape and which has an upwardly directed support face;

a plurality of juxtaposed ejectable charges, lying on the support face;

ejector means for each of the charges for scattering the charges at a distance from the charge support;

locking means for the ejector means for holding the charges against the support face of the charge support; and triggering means for releasing the locking means and ejecting the charges.

2. A munition according to claim 1, wherein the support is, in addition, fixed to a casing enclosing a central non-ejectable charge.

3. A munition according to claim 1, wherein the ejectable charges are plate charges occupying sectors on the support face.

4. A munition according to claim 1, wherein the ejector means comprise springs placed between the support face and each of the ejectable charges, the locking means holding each of the springs in a resiliently loaded position.

5. A munition according to claim 4, wherein releasing the spring also causes the corresponding ejectable charge to be armed.

6. A munition according to claim 5, wherein the spring is a blade spring having one of its ends fixed to the ejectable charge, and wherein a safety pin for locking the firing means of the ejectable charge against firing is extracted from the firing means by the blade spring being released.

7. A munition according to claim 1, wherein the charge support comprises a munition cover, and wherein the munition further includes:

a generally flat munition body including a bearing face and an exposed face, the exposed face being upwardly directed when the mine rests on the ground in the open position, said munition body being covered, in the closed position by the charge support having its support face turned towards the exposed face of the munition body;

a hinge connecting the charge support to the munition body at a peripheral point thereof;

locking means for locking the charge support to hold it in the closed position against the munition body; and opening means for unlocking the charge support and for exerting a pivoting torque thereon to cause it to move through half a turn from the closed position to an open position in which the charge support rests to one side of the munition body with its support face pointing upwards;

said pivoting torque being at least equal to the torque required for overturning the munition body in the event that prior to opening the body was resting with its exposed face pointing downwards.

8. A munition according to claim 7, wherein the munition body encloses an additional, non-ejectable central charge.

9. A munition according to claim 7, wherein the opening means co-operate with the triggering means in such a manner as to free the locking means for locking the ejector means, thereby enabling the charges to be ejected as soon as the charge support reaches the open position.

10. A munition according to claim 9, wherein the locking means for locking the ejectable charges comprise a central fork inserted in a radial slot of the charge support and axially restraining all the ejectable charges, and wherein the triggering means include a wire connecting the fork to a point on the body of the munition with the length of the wire being so chosen that when the charge support and the munition body are disposed relative to each other in the fully open position, the wire exerts sufficient force on the fork to extract it radially from the slot, thereby releasing the ejectable charges for ejection.

11. A munition according to claim 7, wherein the ejectable charges are plate charges in the form of sectors covering the face of the support, with the thickness of the charges being substantially equal to the gap which exists, in the closed position, between the exposed face of the munition body and the charge-supporting face of the charge support.

* * * * *